United States Patent [19]

Manning et al.

[11] Patent Number: 4,864,829

[45] Date of Patent: Sep. 12, 1989

[54] METHOD AND APPARATUS FOR ELECTRONICALLY PRESSURE SEALING AND LEAK TESTING AN IDLE CENTRIFUGAL CHILLER SYSTEM

[75] Inventors: Peter J. Manning, Red Bank, N.J.; Joshua D. Costell, Duluth, Ga.; Howard L. Beckerman, Middletown, N.J.

[73] Assignee: Mechanical Ingenuity Corp., Shrewsbury, N.J.

[21] Appl. No.: 295,907

[22] Filed: Jan. 11, 1989

Related U.S. Application Data

[63] Continuation-in-part of Ser. No. 78,054, Jul. 15, 1987, abandoned, which is a continuation-in-part of Ser. No. 902,768, Sep. 2, 1986, abandoned.

[51] Int. Cl.[4] ..... F25B 47/00

[52] U.S. Cl. ..... 62/85; 62/214; 62/DIG. 17; 62/209

[58] Field of Search ..... 62/208, 209, 216, 132, 62/190, 85, 195, 472, 203, 498, 275, DIG. 17, 214; 219/501, 494

[56] References Cited

U.S. PATENT DOCUMENTS

| | | | |
|---|---|---|---|
| 2,175,913 | 10/1939 | Philipp | 62/472 X |
| 3,082,610 | 3/1963 | Marlo | 62/DIG. 17 |
| 3,518,841 | 7/1970 | West, Jr. | 62/153 |
| 3,590,596 | 7/1971 | Johnson | 62/275 |
| 3,636,723 | 1/1972 | Kramer | 62/197 |
| 4,053,733 | 10/1977 | Murata et al. | 219/494 |
| 4,208,883 | 6/1980 | Stirling | 62/192 |
| 4,506,519 | 3/1985 | Morse et al. | 62/190 |
| 4,785,639 | 11/1988 | Biagini | 62/DIG. 17 |

*Primary Examiner*—Harry B. Tanner
*Attorney, Agent, or Firm*—David L. Davis

[57] ABSTRACT

A method and apparatus for electronically pressure sealing and leak testing an idle centrifugal chiller system wherein a small positive differential is maintained between the internal refrigerant vessel pressure of the chiller system and the ambient atmosphere. This differential pressure is maintained by selectively applying heat to the refrigerant.

14 Claims, 2 Drawing Sheets

METHOD AND APPARATUS FOR ELECTRONICALLY PRESSURE SEALING AND LEAK TESTING AN IDLE CENTRIFUGAL CHILLER SYSTEM

BACKGROUND OF THE INVENTION

This patent application is a Continuation-in-Part of patent application Ser. No. 078,054, filed July 15, 1987, (not abandoned), which is a Continuation-in-Part of patent application Ser. No. 902,768, filed Sept. 2, 1986 (now abandoned).

This invention relates to low pressure refrigeration systems and, more particularly, to a method and apparatus for preventing the infiltration of contaminants into such a system when it is in an idle condition.

A popular form of large air conditioning systems is a centrifugal chiller system wherein water is cooled and then piped to a heat exchanger for cooling circulated air. The basic components of such a system are an evaporator, a condenser, and a centrifugal compressor. Typically, such a system uses R-11 refrigerant, which is a low pressure refrigerant. This means that at temperatures below approximately 74° F., the refrigerant is in a relative vacuum with respect to the ambient atmosphere in which the chiller system resides. If there were no leaks in the system, this would not present a problem. However, due to the nature of such a chiller system, it is virtually impossible to prevent leaks. Thus, the chiller system has many fittings, seals, gaskets, etc., between pipes and components. Due to vibrations associated with running, starting and stopping the compressor, as well as changes in humidity and temperature and human tightening of connections, the fittings, connections, seals, gaskets and the system rupture disc tend to develop leaks.

The problem arises in such a system when leaks develop and the chiller system is shut down or inoperative. When this occurs and the refrigerant cools down, the relative vacuum in the chiller system allows air and moisture from the ambient atmosphere to be drawn into the system. The moisture reacts with the refrigerant to form corrosive acids, which can cause premature chiller failure.

In the past, before system start-up in the spring, it was conventional to perform a leak detection procedure. Such a procedure used either nitrogen, air or hot water. When using nitrogen or air, the system would be charged with the nitrogen or air and the serviceman would check for leaks. The nitrogen or air, mixed with the refrigerant, would then be blown to the atmosphere. The system purger would then be utilized to rid the system of the remaining nitrogen or air. This process took from six to sixteen hours. When utilizing hot water, the hot water would be run through the chilled water pipes of the system to increase the refrigerant temperature which increases the system's pressure. Care had to be taken to prevent the system from becoming over pressurized which 5revent the system from becoming over pressurized which would burst the system's rupture disc, which is typically rated at 15 PSIG.

These conventional methods of leak detection have been found to be unsatisfactory because they require excessive time when it is desired to start up the system. Further, they cause loss of refrigerant because they result in high system pressure which forces out the refrigerant. It is therefore an object of this invention to provide a method and apparatus for leak testing a centrifugal chiller system without the disadvantages encountered with the prior nitrogen, air and hot water methods.

Another disadvantage of the aforedescribed conventional methods of leak detection is that they require a technician to be on-site during the entire pressurization process. Thus, a technician could only service one chiller at a time. It is therefore a further object of this invention to provide a method and apparatus for automatically pressurizing a centrifugal chiller system without requiring the constant attendance of a technician, so that several chillers can be serviced at one time.

Further, after a leak is detected and repaired, another leak test must be performed. Therefore, due to the time intensive, and accordingly expensive, nature of the aforedescribed conventional methods of leak detection, such leak tests were traditionally only performed as part of the annular inspection of the chiller system. It is therefore another object of this invention to provide a method and apparatus which economically permits leak tests to be performed at any time.

Although the conventional methods of leak detection work, they occur after the fact. That is, there are leaks in the system and air and moisture have entered the system, causing damage. Also, even after leak detection and repair, the system returns to a vacuum and further leaks can develop. While it is virtually impossible to prevent a mechanical leak, it is an object of the present invention to provide a method and apparatus for effectively sealing such leaks.

It is another object of this invention to provide such apparatus which may be appended to an existing centrifugal chiller system without affecting the normal operation thereof.

SUMMARY OF THE INVENTION

The foregoing and additional objects are attained in accordance with the principles of this invention by providing an electronic pressure controller for a centrifugal chiller system. An electrical signal corresponding to the differential between the internal refrigerant vessel pressure and the ambient atmosphere is compared with a reference electrical signal corresponding to a desired differential pressure. A difference signal generated as a result of this comparison is utilized for selectively applying heat to the refrigerant to keep the difference signal to a minimum.

In accordance with an aspect of this invention, leak testing is performed by increasing the differential pressure.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
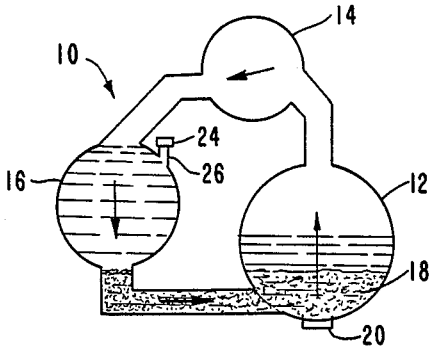
FIG. 1 is a schematic representation of a centrifugal chiller system to which an arrangement according to the present invention is appended.

FIG. 1 illustrates schematically, a typical centrifugal chiller system, designated generally by the reference numeral 10, and having an evaporator 12, a compressor 14 and a condenser 16. Although not shown in FIG. 1, water is circulated in pipes within the evaporator 12. This water is cooled by the refrigerant 18 in the evaporator 12 and is then piped to a heat exchanger (not shown) for cooling circulated air. The foregoing is conventional, and in a typical large air conditioning system, the compressor 14 is a centrifugal compressor and the refrigerant 18 is a low pressure refrigerant, such as a type R-11 refrigerant.

As was discussed above, during the normal course of operation of the refrigeration system 10, vibrations generated by the operation, starting and stopping of the compressor 14, as well as thermal expansion and contraction and other causes, can result in the loosening of fittings and connections which degrades the integrity of the system seals. These leaks are relatively small and do not normally pose a problem when the refrigeration system 10 is operating. However, when the system 10 is idle, for example during the winter, the refrigerant may attain a temperature below approximately 74° F., which results in the internal refrigerant vessel pressure being at a relative vacuum with respect to the ambient atmosphere. This will allow small amounts of moisture and air from the ambient atmosphere to be drawn into the refrigerant vessel, causing the problem previously described. According to the present invention, this problem is avoided by maintaining a positive differential between the internal refrigerant vessel pressure and the ambient atmosphere. This positive pressure differential is very small, being sufficient to prevent air and moisture from the ambient atmosphere from infiltrating into the refrigerant vessel while allowing only a negligible amount of refrigerant to leak into the ambient atmosphere.

Figure 2:
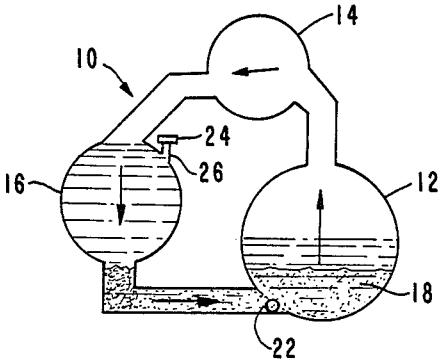
FIG. 2 is a schematic representation of a centrifugal chiller system to which an alternate arrangement according to the present invention is appended.
Figure 3:
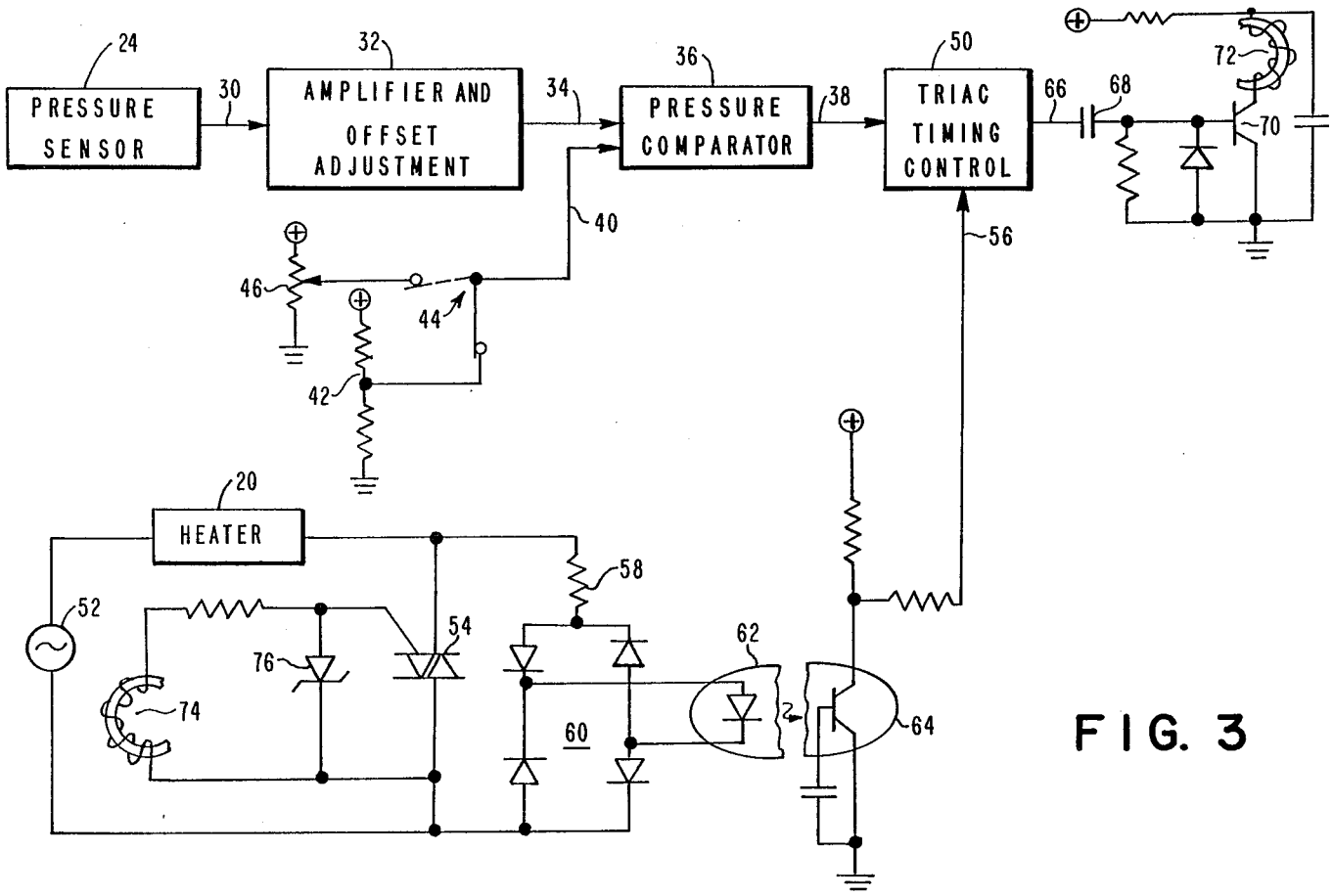
FIG. 3 is a schematic circuit diagram of illustrative circuitry for an arrangement according to this invention.

The system shown in FIG. 3 is operative to provide what may be termed an "electronic pressure seal" for the refrigeration system 10. The system shown in FIG. 3 operates with feedback by applying heat to the refrigerant and measuring the resultant pressure to determine how much, if any, heat is to be applied. To apply the heat, a heater 20 (FIG. 1) is preferably mounted on the bottom of the evaporator 12. A preferred form of heater is a blanket heater of the type which is constructed of silicon material, and having a heating density of approximately 4 watts per square inch. The use of a low density heater covering a large surface area is advantageous since if the heater were localized, this could overheat the refrigerant in the vicinity of the heater, causing carbonization of the refrigerant. The heater 20 is bonded to the bare metal of the evaporator 12, using thermally conductive glue, and is then covered with the insulation material normally used for the evaporator. Alternatively, an internal heater 22 (FIG. 2) may be installed within the evaporator 12.

In order to sense the pressure within the refrigerant vessel, a differential pressure transducer 24, preferably a Part No. 9302901 MEDIAMATE manufactured by Data Instruments Corp., of Acton, MA, is mounted on a fitting 26 at the top of the condenser 16. The use of a differential pressure transducer allows the inventive system to automatically compensate for changes in barometric pressure.

Referring to FIG. 3, the pressure sensor 24 provides an output signal on the line 30. The output of the pressure sensor 24 is at a very low level and, accordingly, this output must be amplified at least sixty times to be at a level for the circuitry to maintain accuracy. Also, the pressure sensor 24 will have some offset voltage associated with it at zero pressure. Accordingly, the output of the pressure sensor on the line 30 is provided as an input to amplifier and offset adjustment circuit 32 for appropriate amplification and adjustment, after which the amplified and adjusted signal is provided on the line 34 as one input to the pressure comparator circuit 36.

The function of the pressure comparator circuit 36 is to compare the pressure as measured by the pressure sensor 24 with a predetermined set point differential pressure and provide an output signal on the line 38 that can be utilized for controlling the heater 20. The other input to the pressure comparator circuit 36 is over the line 40 and is a signal corresponding to a desired differential between the internal refrigerant vessel pressure and the ambient atmosphere. Normally, the inventive system operates in an automatic mode wherein this differential pressure is maintained at 0.05 PSIG and an electrical signal corresponding to this value is provided by the voltage divider 42 which is preset at the factory. This differential pressure has been found to be sufficient to prevent air and moisture from infiltrating into the system from the ambient atmosphere through pinhole leaks while, at the same time, providing negligible leakage of refrigerant into the ambient atmosphere. Thus, the internal refrigerant vessel pressure and the ambient atmopshere are substantially balanced when the inventive system is operative during idle periods of the refrigeration system.

There are times, however, when it may be desirable to increase the pressure differential, for example, in order to effect a leak test. When this is desired, the switch 44 is moved from the position indicated in solid lines to the position indicated by broken lines so that in place of the reference pressure signal provided by the voltage divider 42, a reference pressure signal is applied to the line 40 from the potentiometer 46, which may be adjusted by a service technician. Although not shown herein, indicators are provided so that the technician is aware of the differential pressure setting.

The pressure comparator circuit 36 compares the pressure from the pressure sensor 24, as represented by the amplified and adjusted signal on the line 34, with the set point, or reference, pressure on the line 40. The output of the pressure comparator circuit 36 on the line 38 is a signal representative of the difference between these pressures. When the signals on the lines 34 and 40 are equal, this indicates that the actual and the set point differential pressures are equal, and the signal on the line 38 is at a reference level, illustratively ground. The difference signal on the line 38 is provided as an input to the triac timing control circuit 50. The function of the triac timing control circuit 50 is to utilize the signal provided on the line 38 to determine how much power is to be applied to the heater 20. Specifically, as will be described in full detail hereinafter, the supply of electrical power to the heater 20 is pulse width modulated.

As shown in FIG. 3, the heater 20 is connected in series between an AC power source 52 and a triac 54. The triac timing control circuit 50 determines, based upon the signal provided on the line 38, for what portion of each half cycle of the AC power the triac 54 is to conduct, which in turn determines how much power is supplied to the heater 20. The triac timing control circuit 50 also requires information as to the zero crossings of the AC power so that it can fire the triac 54 at the appropriate time. This information is provided on the lead 56 from the zero crossing detector circuitry.

The zero crossing detector circuitry includes a dropping resistor 58 and a full wave diode bridge circuit 60 in series with the heater 20 and the AC power source 52. The value of the dropping resistor 58 is such that very little current is drawn thereby and the heater is only effective when the triac 54 is conductive. Connected to the diode bridge 60 is one half of an opto-isolator 62, the other half 64 of which provides the zero crossing signal on the line 56. The use of the opto-isolator 62, 64 is to provide isolation between the high power circuitry and the low power logic and control circuitry.

The triac timing control circuit 50 utilizes the input signals provided on the lines 38 and 56 to determine at what point in each half cycle of the AC power the triac 54 should be turned on. When the triac 54 is to be turned on, the triac timing control circuit 50 places a high signal on the line 66. This signal is differentiated by the capacitor 68 to provide a pulse at the gate of the transistor 70. This pulse turns on the transistor 70 for a short period of time which generates a pulse through the primary winding 72 of a pulse transformer. The secondary winding 74 of the pulse transformer is connected to the gate of the triac 54. Accordingly, the pulse generated as a result of the high signal being applied to the line 66 by the triac timing control circuit 50 results in the gate of the triac 54 being pulsed to trigger the triac 54 into conduction for the remainder of the half cycle of AC power. As is well known, at the end of the half cycle of AC power, the triac 54 becomes non-conductive. The Zener diode 76 connected to the gate of the triac 54 protects the gate from the turn on transient generated by the triac's internal capacitance. In conventional triac triggering, this transient is not noticed, but the pulse transformer has no capacitance to offset the internal triac capacitance. As with the opto-isolator, the use of the pulse transformer provides isolation between the low voltage logic and control circuitry and the high power circuitry.

Although not specifically disclosed herein, it is contemplated that safety devices be incorporated in the system to shut down the system and indicate when the set point pressure cannot be attained within a designated time period, or when the pressure exceeds the set point by a predetermined amount and heat is still being applied. The former situation can occur if there is a flow of chiller water, if a heater is defective, if the refrigerant level is too low, or if there is a large leak.

Accordingly, there has been disclosed a method and apparatus for electronically pressure sealing an idle centrifugal chiller system. This apparatus is readily appended to an existing system without affecting the normal operation thereof and automatically compensates for changes in barometric pressure. It is understood that the above-described embodiments are merely illustrative of the application of the principles of this invention. Numerous other embodiments may be devised by those skilled in the art without departing from the spirit and scope of this invention, as defined by the appended claims.

We claim

1. A method for preventing the infiltration of moisture and air from the ambient atmosphere into the refrigerant vessel of an idle low refrigerant pressure centrifugal chiller system, comprising the steps of:

providing an electrical signal corresponding to the differential between the internal refrigerant vessel pressure and the ambient atmosphere;

providing a reference electrical signal corresponding to a desired differential pressure;

comparing said electrical signal with said reference electrical signal;

providing a third electrical signal corresponding to the difference between said electrical signal and said reference electrical signal as determined by said comparing step; and selectively applying heat to said refrigerant vessel so as to minimize said third electrical signal.

2. The method according to claim 1 wherein the step of selectively applying heat includes the step of mounting a low density electrical heater on a lower external surface of the evaporator of the chiller system in thermal contact with the refrigerant therein.

3. The method according to claim 2 wherein the step of selectively applying heat further includes the step of pulse width modulating the supply of electrical power to the electrical heater.

4. The method according to claim 1 wherein the step of providing an electrical signal includes the step of installing a pressure sensing transducer at the top of the system condenser.

5. The method according to claim 1 wherein the step of selectively applying heat includes the step of providing an electrical heater internal to the evaporator.

6. A system for preventing the infiltration of moisture and air from the ambient atmosphere into the refrigerant vessel of an idle low pressure refrigerant centrifugal chiller system, comprising:

pressure sensor means for providing a first electrical signal corresponding to the differential between the internal refrigerant vessel pressure and the ambient atmosphere;

reference means for providing a second electrical signal corresponding to a desired value of said differential pressure;

comparison means arranged to receive said first and second electrical signals for providing a third electrical signal corresponding to the difference between said first and second electrical signals; and heating means utilizing said third electrical signal for selectively applying heat to said refrigerant vessel so as to maintain said third electrical signal at a predetermined level.

7. The system according to claim 6 wherein said heating means includes an electrically powered low density heater mounted on a lower external surface of the evaporator of said chiller system in thermal contact with the refrigerant therein.

8. The system according to claim 7 wherein said heating means further includes:

a controlled switch connected in series with said heater;

means for connecting said heater and said switch to a source of electrical power; and control means responsive to said third electrical signal for controlling the conductivity of said switch.

9. The system according to claim 8 wherein said controlled switch comprises a triac.

10. The system according to claim 9 wherein the source of electrical power is an AC source and said control means includes:

means for detecting zero crossings of the AC power and providing a pulse in response to each zero crossing; and trigger means responsive to said pulse and said third electrical signal for turning on said triac for a portion of each AC power half-cycle.

11. The system according to claim 10 wherein said control means further includes a pulse transformer having its primary winding connected to said trigger means and its secondary winding connected to the gate of said triac.

12. The system according to claim 10 wherein said detecting means includes an opto-isolator having an input section coupled to said AC source and an output section coupled to said trigger means.

13. The system according to claim 6 wherein said reference means includes:

a first source for said second electrical signal, said first source being fixed upon manufacture of said system;

a second source for said second electrical signal, said second source being subject to operator influence for providing a selectively variable desired value of said differential pressure; and means for selecting between said first and second sources to provide said second electrical signal to said comparison means.

14. The system according to claim 6 wherein said heating means includes an electrically powered heater internal to the evaporator.

* * * * *